US005966954A

United States Patent [19]

Arima et al.

[11] Patent Number: 5,966,954

[45] Date of Patent: Oct. 19, 1999

[54] AIR CONDITIONING SYSTEM

[75] Inventors: Hidetoshi Arima; Nobuhiro Idei; Masashi Izumi; Akira Hatakeyama; Hiroyuki Takada, all of Gunma-ken, Japan

[73] Assignee: Sanyo Electronic Co., Ltd., Osaka-fu, Japan

[21] Appl. No.: 08/984,017

[22] Filed: Dec. 3, 1997

[30] Foreign Application Priority Data

| | | | |
|---|---|---|---|
| Dec. 4, 1996 | [JP] | Japan | 8-324232 |
| Dec. 11, 1996 | [JP] | Japan | 8-331297 |
| Jun. 11, 1997 | [JP] | Japan | 9-153908 |

[51] Int. Cl.[6] ..... F25B 5/02

[52] U.S. Cl. ..... 62/185; 62/119; 165/104.22; 165/104.25; 237/2 A; 237/2 B

[58] Field of Search ..... 165/104.21, 104.22, 165/104.25; 62/119, 185; 237/2 A–2 B

[56] References Cited

U.S. PATENT DOCUMENTS

| | | | |
|---|---|---|---|
| 4,664,177 | 5/1987 | Edelstein | 165/1 |
| 5,050,396 | 9/1991 | Ohkoshi et al. | 62/160 |
| 5,224,352 | 7/1993 | Arima et al. | 62/141 |
| 5,293,754 | 3/1994 | Mizuno | 62/185 |
| 5,819,843 | 10/1998 | Inoue et al. | 165/219 |

FOREIGN PATENT DOCUMENTS 7-151359 6/1995 Japan .

OTHER PUBLICATIONS

Japanese Patent Application Laid–Open No. 7–151359 supplied by applicant and laid out in the background of the invention, Jun. 13, 1995.

*Primary Examiner*—Henry Bennett
*Assistant Examiner*—Marc Norman
*Attorney, Agent, or Firm*—Weingarten, Schurgin, Gagnebin & Hayes LLP

[57] ABSTRACT

An air conditioning system comprises a heat source side unit adapted to condense and supply a fluid which can change a phase between a gas phase and a liquid phase and a plurality of user side units entirely or mostly disposed below the heat source side unit in terms of number and connected to said heat source side unit by piping so as to establish a circulation of the fluid supplied from said heat source side unit passing through said heat source side unit and said user side units by utilizing the difference in specific gravity between the liquid phase and the gas phase of said liquid so that it can provide a cooling/heating effect regardless of the floors where the user side units are installed and the power consumption rate of the system can be minimized. More specifically, the heat source side unit 1 and the user side units 4 arranged below the heat source side unit 1 are connected by way of liquid phase piping 6 and gas phase piping 7 to form a closed circuit 3 and a motor pump 10 is arranged along the liquid phase piping 6. Refrigerant R-134a is condensed in the heat source side unit 1 and sent to the user side units 4 by the motor pump 10 in the cooling mode of operation, whereas it is condensed in the user side units 4 and sent to the heat source side unit 1 by the motor pump 10 in the heating mode of operation. The number of revolutions per unit time of the motor pump is controlled modifying the number of poles of the pump or the frequency of the AC fed to the pump.

4 Claims, 7 Drawing Sheets

AIR CONDITIONING SYSTEM

BACKGROUND OF THE INVENTION

1. Field of the Invention

This invention relates to an air conditioning system and, more particularly, it relates to a system adapted to circulate a fluid which can change a phase between a gas phase and a liquid phase through a heat source side unit and a plurality of user side units more than half of which are disposed below the heat source side unit in terms of number by utilizing the difference in specific gravity between the liquid phase and the gas phase of the fluid and the discharging force of a pump arranged along a liquid phase pipe so as to make each of the user side units at least capable of cooling ambient air.

2. Background Art

FIG. 13 of the accompanying drawings schematically illustrates a known air conditioning system of the type under consideration disclosed in Japanese Patent Application Laid-Open No. 7-151359. Referring to FIG. 13, it comprises components including an exterior heat exchanger (hereinafter referred to as heat source side unit) 1 adapted to supply cold or hot water, a plurality of user side units 4 disposed at a level lower than that of the heat source side unit 1, each having a heat exchanger 5 and a flow control valves 8, a motor pump 10 and a number of switch valves 11 through 14, which components are connected by way of liquid phase piping 6 and gas phase piping 7 to form a closed circuit 3 so that a refrigerant sealed in the closed circuit 3 circulates through the heat source side unit 1 and the user side units 4 to provide the user side units 4 with a cooling/heating effect. Reference symbol S14 denotes a liquid level sensor arranged at the user side unit 1 for controlling the motor pump 10 so as to provide the user side unit 1 constantly with a given amount of refrigerant when the system is in operation.

With the known air conditioning system having a configuration as described above, assume here that the temperature of the room where one of the user side units 4 is installed is raised. If the switch valves 11 and 12 are closed whereas the switch valves 13 and 14 are opened along with the flow control valve 8 to feed the user side unit 1 with cooling water for cooling and condensing the refrigerant while the motor pump 10 is at rest, then the refrigerant condensed in the user side unit 1 falls through the liquid phase piping 6 by its own weight to flow into the heat exchanger 5 of the user side unit 4 by way of the switch valves 13 and 14 and the related flow control valve 8.

The refrigerant flown into the heat exchanger 5 absorbs heat from the air in the room by way of the pipe walls of the heat exchanger to cool the inside of the room to become evaporated and flow into the gas phase piping 7 and then to the heat source side unit 1 where the refrigerant is condensed to reduce the internal pressure so that a natural circulation is established in the system without driving the motor pump 10 to forcibly circulate the refrigerant even in summer when the power consumption level may be maximal in the local community. Thus, such a system provides a great advantage of reducing the running cost particularly when the system is in full operation.

If, on the other hand, the switch valves 11 and 14 are closed whereas the switch valves 12 and 13 are opened along with the flow control valve 8 and the motor pump 10 is driven to cool and condense the refrigerant sealed in the closed circuit 3 by the cooling effect of the heat source side unit 1, then the condensed refrigerant in the heat source side unit 1 flows down through the liquid phase piping 6 by its own weight and the discharging effect of the motor pump 10 to get into the heat exchanger 5 by way of the flow control valve 8 so that a circulation of refrigerant is forcibly established to provide a cooling effect in the room.

Thus, when the motor pump lo is driven for cooling, the system provides an advantage of supplying the heat exchanger 5 of the user side unit 4 with refrigerant at an sufficiently high rate, if the unit 4 is arranged on an upper floor located directly below the heat source side 1.

Now, assume that the temperature of the room where one of the user side units 4 is installed falls. If the switch valves 13 and 14 are closed whereas the switch valve 11 and 14 are opened along with the flow control valve 8 and the motor pump 10 is driven to supply the heat source side unit 1 with hot water and heat and evaporate the refrigerant sealed in the closed circuit 3, then the vapor of refrigerant produced in the heat source side unit 1 is made to flow into the heat exchanger 5 by way of the gas phase piping 7.

The vapor of refrigerant flown into the heat exchanger 5 emits heat into the room by way of the pipe walls of the heat exchanger 5 to raise the temperature in the room and, at the same time, become condensed before it flows into the liquid phase piping 6 and then back to the heat source side unit 1 by way of the switch valves 14 and 11 under the driving effect of the motor pump 10 to establish a circulation of refrigerant so that the user side unit 4 keeps on operating to heat the inside of the room.

With the above described known air conditioning system according to Japanese Patent Application Laid-Open No. 7-151359, while the power consumption rate and hence the running cost of the system are reduced in summer when the power consumption level may be maximal in the local community if the motor pump is held at rest to establish a natural circulation of refrigerant, the user side units may not operate effectively for cooling nor provide a satisfactory cooling effect when they are arranged at a level close to that of the heat source side unit.

If the motor pump is driven for cooling, the power consumption rate of the motor pump will become significant although the user side units that are arranged at a level close to that of the heat source side unit may be fed with refrigerant at a sufficient rate to provide a satisfactory cooling effect. It will be appreciated that the power consumption rate of the motor pump will always be significant because the motor pump has to have a large output power that can draw the refrigerant condensed in the user side units up to the heat source side unit located higher than them.

Thus, there is a need for a air conditioning system that can provide a satisfactory cooling effect and, at the same time, effectively suppress the power consumption rate even in mid summer when the power consumption level may be maximal in the local community.

Additionally, known air conditioning systems of the type under consideration are accompanied by a drawback of unsatisfactory operation that appears when the pressure of the refrigerant contained in the closed circuit drops abruptly while the system is operating for cooling because the refrigerant in the liquid phase piping starts boiling to produce bubbles and becomes unable to play its role. Another drawback of known air conditioning systems is that most of the refrigerant in the liquid state can held in the heat source side unit when the system is operating for cooling so that only an insufficient amount of refrigerant circulates through the user side units.

SUMMARY OF THE INVENTION

According to a first aspect of the invention, the above identified problems and other problems of known air conditioning systems are dissolved by providing an air conditioning system comprising a heat source side unit adapted to condense and supply a fluid which can change a phase between a gas phase and a liquid phase, a plurality of user side units more than half of which are disposed below the heat source side unit in terms of number and which are connected to said heat source side unit by piping so as to establish a circulation of the fluid supplied from said heat source side unit passing through said heat source side unit and said user side units by utilizing the difference in specific gravity between the liquid phase and the gas phase of said liquid, a liquid pump arranged along the liquid phase part of the piping for forcibly boosting the circulation of the fluid in the liquid phase by its pumping power to operate said user side units for cooling ambient air and a control means for controlling the operation of said liquid pump so as to make a preselected physical amount get to a predetermined state.

Preferably, said control means of the air conditioning system according to the first aspect of the invention controls the number of revolutions per unit time of said liquid pump by detecting a physical volume relating to the air conditioning load of the user side units.

Alternatively, said control means controls the number of revolutions per unit time of said liquid pump by detecting a physical volume relating to the rate of power consumption of the heat source side unit for the cooling operation.

Preferably, said control means controls the number of revolutions per unit time of said liquid pump by modifying the number of poles of the electric motor for driving said liquid pump, the frequency of the AC being fed to said drive motor and/or the voltage or the intensity of the AC if said control means is adapted to detect a physical volume relating to the air conditioning load of the user side units.

Said control means controls the number of revolutions per unit time of said liquid pump by modifying the number of poles of the electric motor for driving said liquid pump, the frequency of the AC being fed to said drive motor and/or the voltage or the intensity of the AC if said control means is adapted to detect a physical volume relating to the rate of power consumption of the heat source side unit for the cooling operation.

According to a second aspect of the invention, there is also provided an air conditioning system comprising a heat source side unit adapted to condense/evaporate and supply a fluid which can change a phase between a gas phase and a liquid phase, a plurality of user side units entirely or mostly disposed below the heat source side unit in terms of number and connected to said heat source side unit by piping so as to establish a circulation of the fluid supplied from said heat source side unit passing through said heat source side unit and said user side units by utilizing the difference in specific gravity between the liquid phase and the gas phase of said liquid, a first liquid pump arranged along the liquid phase part of the piping for forcibly boosting the circulation of the fluid in the liquid phase by its pumping power to supply said user side units with fluid including the liquid phase and causing the supplied fluid to evaporate in the user side units for cooling ambient air, a second liquid pump arranged along a part of the piping adapted to sending the fluid in said liquid phase part of the piping back to said heat source side unit, a switch valve arranged between the discharge side of said first liquid pump and said liquid phase part of the piping and adapted to be opened for cooling and closed for heating so as to cause the fluid in the gas phase evaporated in and supplied from said heat source side unit to circulate through said user side units and said heat source side unit under the negative pressure generated by the second liquid pump and make the gas phase supplied to the user side units to be condensed there for a subsequent heating operation and control means for controlling the operation of said heat source side unit according to the condition of the fluid circulating through said heat source side unit and said user side units.

Preferably, said control means of the air conditioning system according to the second aspect of the invention controls the capacity of said heat source side unit according to the pressure of the condensed fluid being supplied from said heat source side unit and stops the operation of said heat source side unit when the temperature of the fluid falls below a predetermined level.

Preferably, the air conditioning system according to the second aspect of the invention further comprises a receiver tank arranged on the suction side of said first liquid pump for storing condensed fluid supplied from said heat source side unit and a detection means for detecting the volume of the fluid in said heat source side unit, said control means being so adapted to stop the operation of said first liquid pump when the level of the liquid in said receiver tank falls below a predetermined level and that of said heat source side unit when the volume of the liquid in said heat source side unit as detected by said detection means exceeds a predetermined level.

Alternatively, the air conditioning system according to the second aspect of the invention may further comprise a receiver tank arranged on the suction side of said second liquid pump for storing fluid in the liquid phase and a detection means for detecting the volume of the fluid in said heat source side unit, said control means being so adapted to stop the operation of said second liquid pump when the level of the liquid in said receiver tank falls below a predetermined level or the volume of the liquid in said heat source side unit detected by said detection means exceeds a first predetermined level and that of said heat source side unit when the volume of the liquid in said heat source side unit as detected by said detection means falls below a second predetermined level lower than said first predetermined level.

If the air conditioning system comprises the receiver tank arranged on the suction side of said first liquid pump, the discharge side of said first liquid pump and an upper portion of said receiver tank are connected to each other by way of a relief valve adapted to be opened under pressure exceeding a predetermined level.

BRIEF DESCRIPTION OF THE DRAWINGS

FIG. 9 is a flow chart for the operation of preventing insufficient circulation of refrigerant R-134a.

DETAILED DESCRIPTION OF THE PREFERRED EMBODIMENTS

Now, the invention will be described by referring to FIGS. 1 through 12 of the accompanying drawings that illustrate preferred embodiments of the invention. For the purpose of simplicity, the components similar to or identical with their counterparts of FIG. 13 will be denoted respectively by the same reference symbols throughout the drawings.

Figure 1:
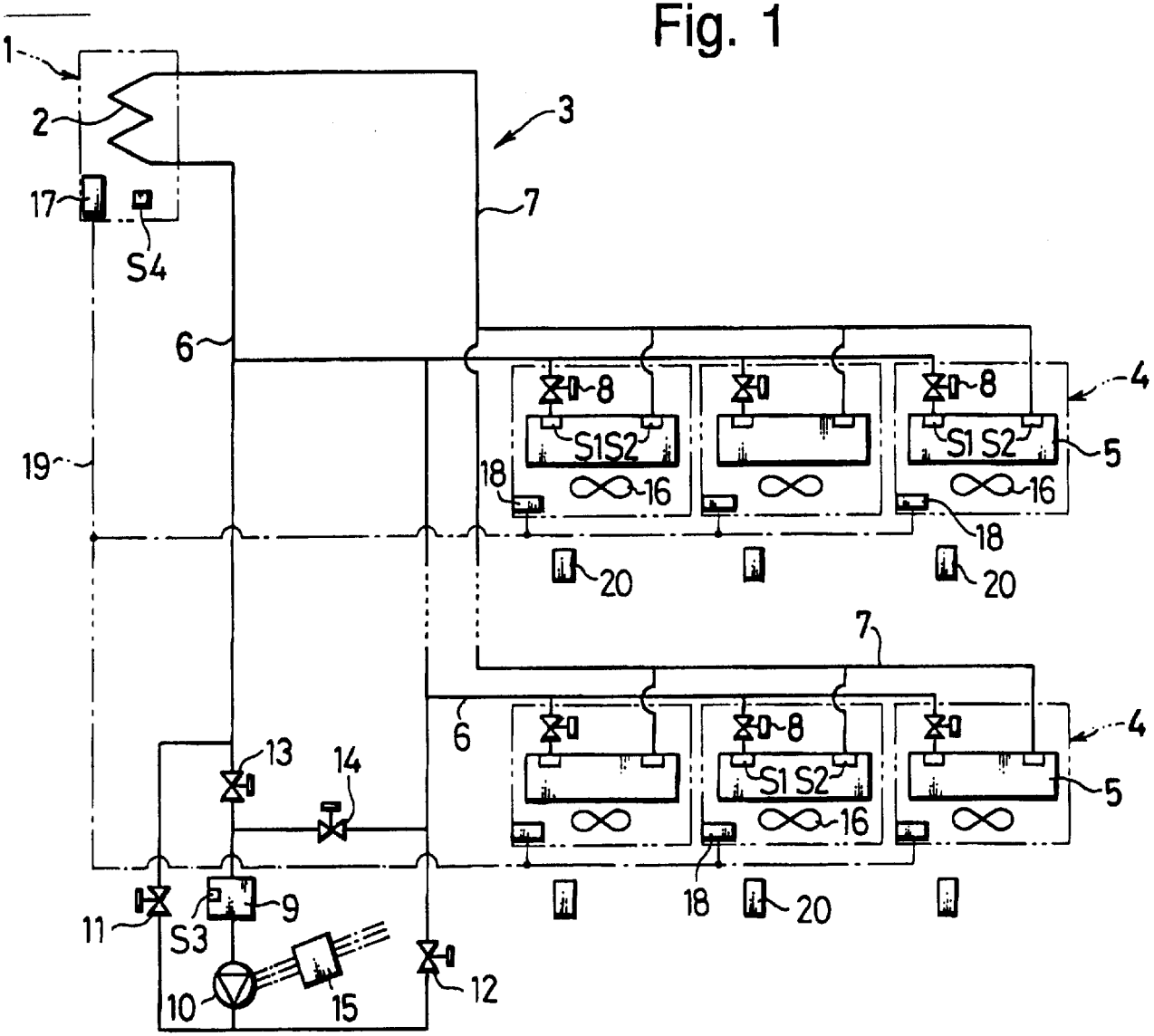
FIG. 1 is a schematic circuit diagram of a first embodiment of an air conditioning system according to the present invention.

FIG. 1 is a schematic circuit diagram of a first embodiment of air conditioning system according to the invention. Referring to FIG. 1, it comprises a heat source side unit 1 that operates for cooling or heating whenever necessary and is installed on a roof or in a machine housing of a building. It is adapted to change the phase of a phase-changeable fluid refrigerant sealed in a closed circuit 3, which may be a refrigerant R-134a which can easily change a phase between a gas phase and a liquid phase, by exchanging heat with the refrigerant by means of a heat exchanger 2 arranged, for example, in an evaporator. Note that R-134a in the liquid phase can be readily evaporated at low temperature when the pressure is reduced.

For the purpose of the present invention, an absorption type freezer as disclosed in U.S. Pat. No. 5,224,352 may suitably be used for cooling and heating the fluid refrigerant by exchanging heat with the fluid passing through the inside of the heat exchanger 2 that is arranged and piped in an evaporator.

As shown in FIG. 1, the heat exchanger 2 of the heat source side unit 1 and the heat exchangers 5 of the user side units 4 are connected by way of liquid phase piping 7, gas phase piping 7, respective flow control valves 8, a receiver tank 9, a motor pump 10 and switch valves 11 through 14 to form a closed circuit 3.

Otherwise, the system comprises a frequency converter 15 for changing the frequency of the AC supplied to drive the motor pump 10. Each of the user side units 4 is provided with a blower 16 for blowing air to the heat exchanger 5 to circulate air in the room and a pair of sensors S1 and S2 for arranged respectively at the R-134a inlet and outlet ports of the heat exchanger to detect the temperatures of the R-134a there. It will be appreciated that the difference between the temperature detected by the temperature sensor S1 at the inlet port and the one detected by the temperature sensor S2 at the outlet port will be increased as the air conditioning load of the system rises and decreased as the load falls.

Reference symbol S3 denotes a liquid level sensor for detecting the level of the liquid R-134a held in the receiver tank 9 and reference symbol S4 denotes a thermal energy sensor for detecting the amount of the thermal energy applied to the heat source side unit 1 to condense the R-134a there.

Additionally, the heat source side unit 1 has a heat source side controller 17, whereas each of the user side units 4 has a user side controller 18. The user side controller 18 comprises a signal generator (not shown) adapted to generate communication signals representing the opening of the flow control valve 8 and the temperatures detected by the temperature sensors S1 and S2 and convert the externally applied communication signals into corresponding control signals. The heat source side controller 17 and the user side controllers 18 are connected by way of signal wiring 19 so that each of the user side controllers 18 receives the signals transmitted from the heat source side controller 17 to control the opening of the related flow control valve 8.

Each of the user side units 4 is further provided with a remote controller 20 adapted to communicate with the corresponding user side controller 18 in order to remotely start/stop a cooling or heating operation and control the Intensity of the air flow blown out of the unit and the air temperature. The heat source side controller 17 is connected to the liquid level sensor S3, the thermal energy sensor and the frequency converter 15 by way of signal lines (not shown) to exchange signals there between.

With the air conditioning system having such a configuration as described above, when the room temperature is raised, the motor pump 10 is driven to operate, keeping the switch valves 11 and 14 closed and the switch valves 12 and 13 opens while the R-134a in the closed circuit 3 is cooled by the heat exchanger 2 of the heat source side unit 1. Then, the R-134a is cooled and condensed by way of the pipe walls of the heat exchanger 2 until it is flown out into the downstream liquid phase piping 6 and then further to the heat exchangers 5 of the user side units 4 by the own weight of the R-134a held in the liquid phase piping 6 and the discharging force of the motor pump 10 to feed the heat exchangers 5 with a sufficient amount of R-134a.

Since each of the heat exchangers 5 is forcibly exposed to hot air in the room by means of the related blower 16, the R-134a is evaporated to cool the room as it absorbs heat from the hot air. Then, the R-134a that has been cooled, condensed and liquefied is sent back to the heat exchanger 2 of the heat source side unit 1 by way of the gas phase piping 7 as the heat exchanger 2 is under reduced pressure.

During the above described cooling cycle, the number of revolutions per unit time of the motor pump 10 is SO controlled by the heat source side controller 17 as to maintain the surface of the R-134a in the receiver tank 9 as detected by the liquid level sensor S3 to a predetermined level.

Figure 2:
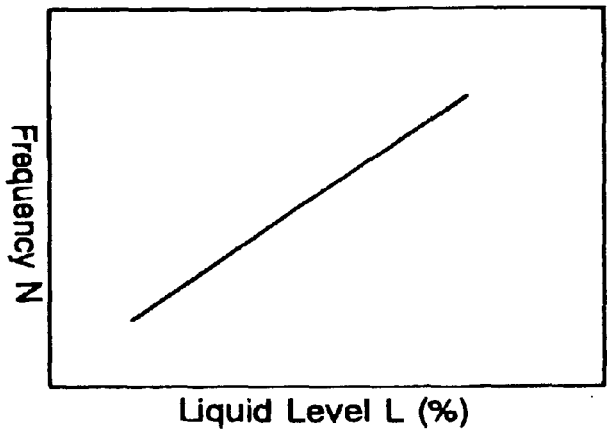
FIG. 2 is a graph schematically illustrating the relationship between the frequency of the AC for driving the motor pump and the liquid level that can be used for the purpose of the present invention.

More specifically, referring to FIG. 2, the number of revolutions per unit time of the motor pump 10 is controlled in such a way that the heat source side controller 17 reduces the frequency N of the AC being supplied to the motor pump 10 by means of the frequency converter 15 when the level L of the liquid R-134a in the receiver tank 9 detected by the level sensor S3 (expressed in terms of percentage relative to the elevation difference between the upper and lower limits) is low, whereas it is raised when the level L of the liquid R-134a is high in a manner as shown in FIG. 2.

Thus, with the air conditioning system according to the invention, liquid R-134a is transferred as a function of the value obtained by adding the pumping force of the motor pump 10 to the difference between the specific gravity of liquid R-134a and that of gaseous R-134a. With this arrangement, the R-134a of the system is made to reliably circulate within the system f or a cooling cycle if some of the user side units 4 are located at a level same as that of the heat source side unit 1 or even higher than the level of the latter and the power consumption of the system is minimized since the number of revolutions per unit time of the motor pump 10 is controlled by means of the frequency of the AC supplied to it.

If the level L of the liquid R-134a in the receiver tank 9 detected by the liquid level sensor S3 is lower than a predetermined value, the number of revolutions per unit time of the motor pump 10 is reduced by operating all the poles of the motor pump 10. To the contrary, if the level L of the liquid R-134a in the receiver tank 9 is higher than a predetermined value, the number of revolutions per unit time of the motor pump 10 is raised by modifying the wiring arrangement to leave part of the poles of the motor pump 10 out of operation. Alternatively, the number of revolutions per unit time of the motor pump 10 may be controlled by modifying the voltage and/or the intensity of the AC supplied to it.

Still alternatively, the number of revolutions per unit time of the motor pump 10 may be controlled according to the air conditioning load calculated on the basis of the temperature data obtained by the temperature sensors S1 and S2 or according to the data on the thermal energy applied to the heat source side unit 1 and detected by the thermal energy sensor S4.

Figure 3:
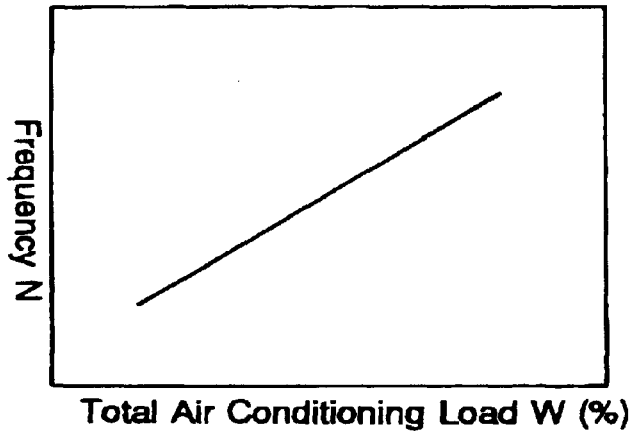
FIG. 3 Is a graph schematically illustrating the relationship between the frequency of the AC for driving the motor pump and the air conditioning load that can be used for the purpose of the present invention.
Figure 4:
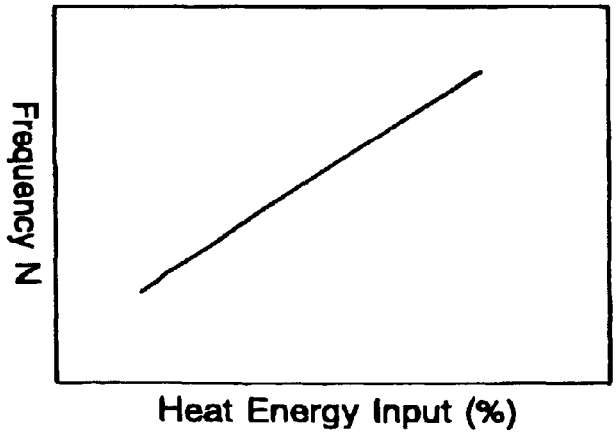
FIG. 4 is a graph schematically illustrating the relationship between the frequency of the AC for driving the motor pump and the supplied thermal energy that can be used for the purpose of the present invention.

More specifically, the number of revolutions per unit time of the motor pump 10 may be controlled by means of the frequency converter 15 that changes the frequency N of the AC supplied to the motor pump 10 from the heat source side controller 17 according to the total air conditioning load W (expressed in terms of percentage) calculated from the data on the temperature difference of the R-134a detected by the temperatures sensors S1 and S2 of all the user side units 4 in a manner as shown in FIG. 3. In this case again, the number of revolutions per unit time of the motor pump 10 may be controlled by modifying the number of poles of the motor pump 10 as described above by referring to the method of controlling the number of revolutions per unit time of the motor pump 10 by detecting the liquid level L of the R-134a in the receiver tank 9.

Still alternatively, the number of revolutions per unit time of the motor pump 10 may be controlled according to the amount of the thermal energy Q applied to the heat source side unit 1 as detected by the thermal energy sensor S4 (and expressed in terms of the percentage of the opening of the fuel valve, see FIG. 6 which will be described hereinafter) and by changing the frequency N of the AC supplied to the motor pump 10 from the heat source side controller 17 by means of the frequency converter 15 or by modifying the number of poles of the motor pump 10 as described above by referring to the method of controlling the number of revolutions per unit time of the motor pump 10 by detecting the liquid level L of the R-134a in the receiver tank 9.

With any of the above described methods, the number of revolutions per unit time of the motor pump 10 can be controlled to reliably circulate the R-134a for the cooling cycle with a minimal power consumption level of the system.

The temperature sensors S1 and S2 of each of the user side units 4 may be so arranged as to detect the temperature change in the air blown to the heat exchanger 5 in the room or they may be replaced by a pair of pressure sensors arranged to detect the difference between the R-134a pressure at the outlet port and the pressure at the inlet port of the heat exchanger 5, which difference is then notified to the heat source side controller 17 as the air conditioning load of the system.

The data on the air conditioning load to be used for controlling the number of revolutions per unit time of the motor pump 10 may be the sum of values representing the respective openings of the flow control valves 8

It will be appreciated that, if the heat exchangers 5 of the user side units 4 located on upper floors and those of the user side units 4 located on lower floors show a same opening, more R-134a will flow into the heat exchangers 5 of the user side units 4 located on lower floors than into their counterparts of the user side units 4 located on upper floors. Therefore, the frequency N of the AC supplied to the motor pump 10 is preferably selected by determining the sum of the values representing the respective openings of the flow control valves 8 that are weighted to accommodate the above differences in the amount among the heat exchangers 5 of the user side units 4.

If the temperature sensors S1 and S2 of the heat exchangers 5 of the user side units 4 provide same temperature data, the volume of R-134a fed to each of the heat exchangers 5 of the user side units installed on different floors cannot be optimized if a some and identical control signal is fed to the flow control valves 8 to realized a same opening at all the flow control valves. Therefore, a control program designed to realize a broader opening for the flow control valve 8 of a user side unit 4 installed in an upper floor have to be provided. Assume that ten user side units 4 are arranged on ten different floors. A correction weight of 1 may be assigned to the user side unit 4 of the lowest floor and a correction weight obtained by adding 0.1 to that of the user side unit 4 of the lowest floor may be assigned to the user side unit 4 of the second lowest floor and so on. Then, a preliminary opening of each of the flow control valves 8 will be determined firstly according to the temperature data obtained by the temperature sensors S1 and S2 and the obtained value representing the preliminary opening will be corrected by multiplying it with the correction weight value assigned to the user side unit 4 having that specific flow control valve 8 in order to determine the final opening of that flow control valve 8. Meanwhile the heat source side controller 17 stores a control program for transmitting a control signal for controlling the opening of each of the flow control valves 8 of the user side units 4 to the related user side controller 18 so that the flow control valve 8 is controlled for its opening according to the control program and the control signal representing the final opening of the valve 8 and transmitted from the program.

At the same time, the heat source side controller 17 stores a program for determining the frequency N of the AC supplied to the motor pump 10 by assigning a correction weight of 1 to the user side unit 4 of the lowest floor and a correction weight obtained by adding 0.1 to that of the user side unit 4 of the lowest floor to the user side unit 4 of the second lowest floor and so on and dividing the values representing the detected actual openings of the flow control valves 8 respectively by the corresponding correction weight values to determine the respective corrected openings so that the frequency N of the AC supplied to the motor pump 10 may be controlled according to the corrected openings of the flow control valves 8 determined in a manner as described above.

Note that, when only the user side units 4 of lower floors are operated for cooling, a sufficient amount of R-134a can be fed to the heat exchangers 5 of the user side units 4 of the lower floors by the own weight of the R-134a remaining in the liquid phase piping 6 without driving the motor pump 10 if the switch valves 11 and 12 are closed and the switch valves 13 and 14 are opened so that the cooling cycle can be realized economically while the motor pump 10 is at rest.

If the room temperature is relatively low, the switch valves 12 and 13 are closed, while the switch valves 11 and 14 are held open, and the R-134a contained in the closed circuit 3 is heated to evaporate by the heat exchanger 2 of the heat source side unit 1 so that the R-134a vapor is fed to the user side units 4 by way of the gas phase piping 7 to cause the heat exchangers 5 of the user side units 4 to emit heat into the relatively cold air blown to them by means of the blowers for a heating cycle. The number of revolutions per unit time of the motor pump 10 for sending the R-134a condensed and liquefied as a result of the heating cycle back to the heat source side unit 1 will also be controlled by controlling the frequency N of the AC supplied to the motor pump 10 or the number of operating poles of the motor pump 10 as in the case the cooling cycle described earlier.

It will be appreciated that the frequency N of the AC supplied to the motor pump 10 and the number of operating poles of the motor pump 10 can be controlled for a heating cycle according to the total air conditioning load W calculated from the data obtained by the temperature sensors S1 and S2, the liquid R-134a level L detected by the level sensor S3 or the amount of thermal energy Q applied to the heat source side unit 1 and detected by the thermal energy sensor 54 exactly in a manner as described earlier by referring to the cooling cycle. However, care should be taken when the opening of each of the flow control valves 8 is used for the control operation because the correction weight values have to be incrementally modified in the opposite direction.

More specifically, as for the liquid R-134a condensed by the heat exchangers 5, the heat exchanger 5 located on a lower floor have a smaller difference in the elevation between itself and the receiver tank 9 so that the liquid R-134a in that heat exchanger 5 will be discharged to the receiver tank 9 side with a greater degree of difficulty Meanwhile, the gaseous R-134a evaporated in the heat exchanger 2 of the heat source side unit 1 shows a lower pressure in the heat exchanger 5 located on a lower floor so that, again, the liquid R-134a in that heat exchanger 5 will be discharged to the receiver tank 9 side with a greater degree of difficulty. Thus, to obtain a given heating load, the flow control valve 8 of the heat exchanger 5 located on a lower floor has to show a greater opening for the heating cycle.

If the temperature sensors S1 and S2 of the heat exchangers 5 of the user side units 4 provide same temperature data, the heat source side controller 17 has to be made to store a control program designed to realize a broader opening for the flow control valve 8 of a user side unit 4 installed in a lower floor. Assume, for example, that ten user side units 4 are arranged on ten different floors. A correction weight of 1 may be assigned to the user side unit 4 of the highest floor and a correction weight obtained by adding 0.05 to that of the user side unit 4 of the highest floor may be assigned to the user side unit 4 of the second highest floor and so on. Then, a preliminary opening of each of the flow control valves 8 will be determined firstly according to the temperature data obtained by the temperature sensors S1 and S2 and the obtained value representing the preliminary opening will be corrected by multiplying it with the correction weight value assigned to the user side unit 4 having that specific flow control valve 8 in order to determine the final opening of that flow control valve 8. Meanwhile the control program stored in the heat source side controller 17 is also designed to transmit a control signal for controlling the opening of each of the flow control valves 8 of the user side units 4 to the related user side controller 18 so that the flow control valve 8 is controlled for its opening according to the control program and the control signal representing the final opening of the valve 8 and transmitted from the program.

At the same time, the heat source side controller 17 stores a program for determining the frequency N of the AC supplied to the motor pump 10 by assigning a correction weight of 1 to the user side unit 4 of the highest floor and a correction weight obtained by adding 0.05 to that of the user side unit 4 of the highest floor to the user side unit 4 of the second highest floor and so on and dividing the values representing the detected actual openings of the flow control valves 8 respectively by the corresponding correction weight values to determine the respective corrected openings so that the frequency N of the AC supplied to the motor pump 10 may be controlled according to the corrected openings of the flow control valves 8 determined in a manner as described above.

Figure 5:
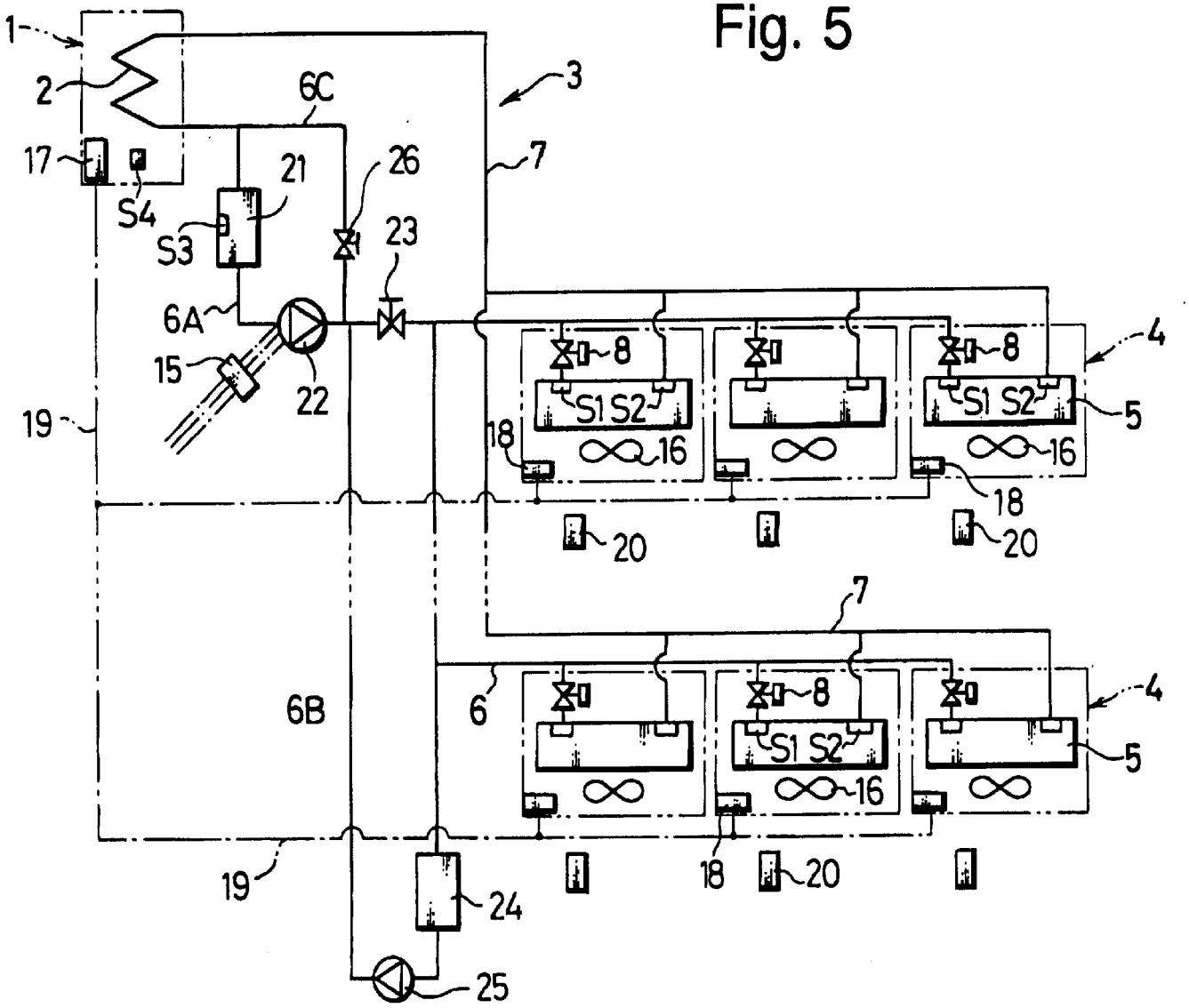
FIG. 5 is a schematic circuit diagram of a second embodiment of an air conditioning system according to the present invention.

FIG. 5 is a circuit diagram of a second embodiment of air conditioning system according to the invention comprising a heat source side unit 1 having a heat exchanger 2 and typically housed in a machine housing located on the roof of a building and a number of user side units 4 having respective heat exchangers 5, said heat exchangers 2 and 5 are connected by way of liquid phase piping 6, gas phase piping 7 and flow control valves 8 to form a closed circuit 3.

Reference numerals 21, 22 and 23 respectively denote a receiver tank arranged in a common area 6A of the liquid phase piping 6, a small motor pump 10 to be operated as an auxiliary cooling pump in the initial stages of the cooling cycle and a cooling/heating switch valve (switch valve) that is opened for the cooling cycle and closed for the heating cycle. Reference symbol 6B denotes a bypass pipe connected to the common area 6A of the liquid phase piping to bypass the cooling/heating switch valve 23. Otherwise, the embodiment comprises a receiver tank 24 arranged along the bypass pipe 6B, a large motor pump 25 to be operated in the initial stages of the heating cycle, a bypass pipe 6C connected to the common area 6A of the liquid phase piping for bypassing the receiver tank 21 and the motor pump 22 and a cooling/heating switch valve 26 arranged in the bypass pipe 6C, which value 26 is closed for the cooling cycle and opened for the heating cycle.

The receiver tank 21 is provided with a liquid level sensor S3 for detecting the level of the liquid R-134a held in the receiver tank 21. As in the case of the embodiment of FIG. 1, there are also provided a heat source side controller 17, user side controllers 18 and remote controllers 20 adapted to communicate with the respective user side controllers 18 for signal exchange.

With the second embodiment having a configuration as described above, when the room temperature is raised, the motor pump 22 is driven to operate, keeping the cooling/heating switch valve 26 closed and the cooling/heating switch valve 23 open, while the R-134a in the closed circuit 3 is cooled by the heat exchanger 2 of the heat source side unit 1, keeping the motor pump 25 at rest. Then, the R-134a is cooled and condensed by way of the pipe walls of the heat exchanger 2 until it is flown out into the downstream liquid phase piping 6 and then further to the heat exchangers 5 of the user side units 4 by the own weight of the R-134a held in the liquid phase piping 6 and the discharging force of the motor pump 22 to feed the heat exchangers 5 with a sufficient amount of R-134a.

Since each of the heat exchangers 5 is forcibly exposed to hot air in the room by means of the related blower 16, the R-134a is evaporated to cool the room as it absorbs heat from the hot air. Then, the R-134a that has been cooled, condensed and liquefied is sent back to the heat exchanger 2 of the heat source side unit 1 by way of the gas phase piping 7 as the heat exchanger 2 is under reduced pressure.

During the above described cooling cycle, the number of revolutions per unit time of the motor pump 22 of this embodiment is so controlled by the heat source side controller 17 as to maintain the surface of the R-134a in the receiver tank 21 as detected by the liquid level sensor S3 to a predetermined level.

More specifically, the number of revolutions per unit tine of the motor pump 22 is controlled in such a way that the heat source side controller 17 reduces the frequency N of the AC being supplied to the motor pump 22 by means of the frequency converter 15 when the level L of the liquid R-134a in the receiver tank 21 detected by the level sensor S3 (expressed in terms of percentage relative to the elevation difference between the upper and lower limits) is low, whereas it is raised when the level L of the liquid R-134a is high in a manner as illustrated in FIG. 2.

Thus, with the embodiment of air conditioning system according to the invention and illustrated in FIG. 5, liquid R-134a is transferred as a function of the value obtained by adding the pumping force of the motor pump 22 to the difference between the specific gravity of liquid R-134a and that of gaseous R-134a. With this arrangements the R-134a of the system is made to reliably circulate within the system for the cooling cycle if some of the user side units 4 are located at a level same as that of the heat source side unit 1 or even higher than the level of the latter and the power consumption of the system is minimized since the number of revolutions per unit time of the motor pump 22 is controlled by means of the frequency of the AC supplied to it.

Alternatively, the number of revolutions per unit time of the motor pump 22 may be controlled according to the air conditioning load calculated on the basis of the temperature data obtained by the temperature sensors S1 and S2 or according to the data on the thermal energy applied to the heat source side unit 1 and detected by the thermal energy sensor S4.

More specifically, the number of revolutions per unit time of the motor pump 22 may be controlled by means of the frequency converter 15 that changes the frequency N of the AC supplied to the motor pump 22 from the heat source side controller 17 according to the total air conditioning load W (expressed in terms of percentage) calculated from the data on the temperature difference of the R-134a detected by the temperatures sensors S1 and S2 of all the user side units 4 in a manner as shown in FIG. 3.

Still alternatively, the number of revolutions per unit time of the motor pump 22 may be controlled according to the amount of the thermal energy Q applied to the heat source side unit 1 as detected by the thermal energy sensor S4 (and expressed in terms of the percentage of the opening of the fuel valve) and by changing the frequency N of the AC supplied to the motor pump 10 from the heat source side controller 17 by means of the frequency converter 15 as described above by referring to the method of controlling the number of revolutions per unit time of the motor pump 10 by detecting the liquid level L of the R-134a in the receiver tank 21.

With any of the above described methods, the number of revolutions per unit time of the motor pump 22 can be controlled to reliably circulate the R-134a for the cooling cycle with a minimal power consumption level of the system.

As described earlier by referring to FIG. 1, the temperature sensors S1 and S2 of each of the user side units 4 may be so arranged as to detect the temperature change in the air blown to the heat exchanger 5 in the room or they may be replaced by a pair of pressure sensors arranged to detect the difference between the R-134a pressure at the outlet port and the pressure at the inlet port of the heat exchanger 5, which difference is then notified to the heat source side controller 17 as the air conditioning load of the system.

The data on the air conditioning load to be used for controlling the number of revolutions per unit time of the motor pump 22 may be the sum of values representing the respective openings of the flow control valves 8, taking the floors carrying the user side units 4 into consideration as in the case of the motor pump 10 described above by referring to FIG. 1.

With the second embodiment having a configuration as described above, when the room temperature falls, the motor pump 25 is driven to operate, keeping the cooling/heating switch valve 26 open and the cooling/heating switch valve 23 closed, while the R-134a in the closed circuit 3 is heated by the heat exchanger 2 of the heat source side unit 1, keeping the motor pump 22 at rest. Then, the R-134a is heated to evaporate by way of the pipe walls of the heat exchanger 2 until it is moved into the gas phase piping 7 and then further to the heat exchangers 5 of the user side units 4.

Since each of the heat exchangers 5 is forcibly exposed to cool air in the room by means of the related blower 16, the R-134a is condensed to emit heat into the room for the heating cycle. Then, the R-134a that has been condensed and liquefied is sent back to the lower receiver tank 24 through the flow control valves 8 and then further back to the heat exchanger 2 of the heat source side unit 1 to circulate through the closed circuit 3 for the heating cycle.

The cooling/heating switch valve 26 may be replaced by a relief valve that is normally closed and becomes open only when the pressure applied to it exceeds a predetermined level so that it automatically opens when the pressure of the R-134a discharged by the motor pump 22 exceeds a predetermined level to allow the R-134a to return the receiver tank 21. The receiver tank 21, the motor pump 22 and the cooling/heating switch valves 23 and 26 may be housed within the heat source side unit 1 to simplify the overall system configuration.

Figure 6:
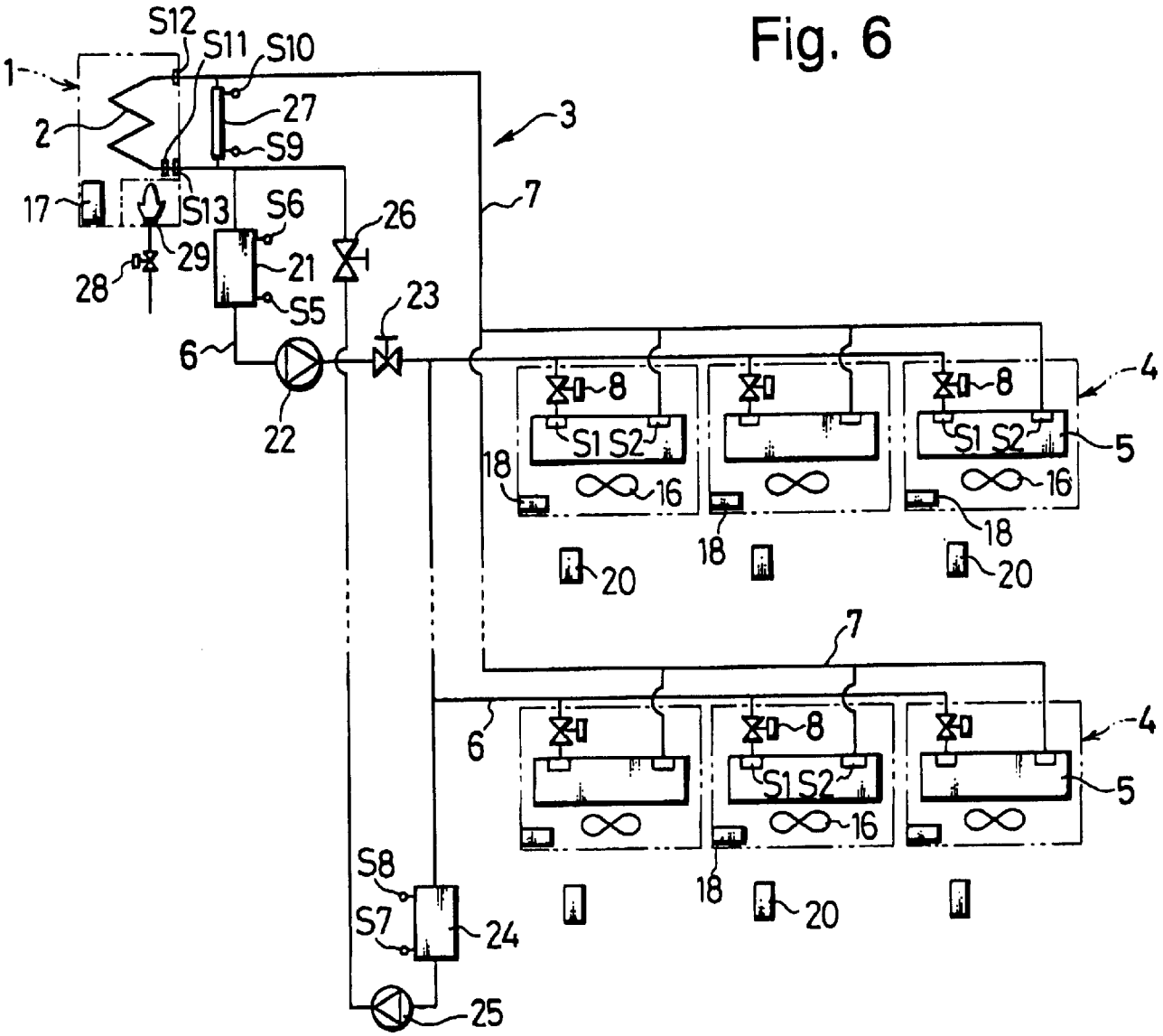
FIG. 6 is a schematic circuit diagram of a third embodiment of an air conditioning system according to the present invention.
Figure 7:
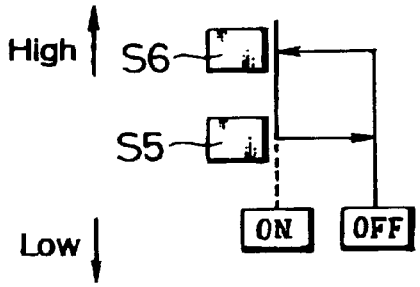
FIG. 7 is a schematic circuit diagram of the controller for controlling the motor pump for the purpose of the present invention.
Figure 8:
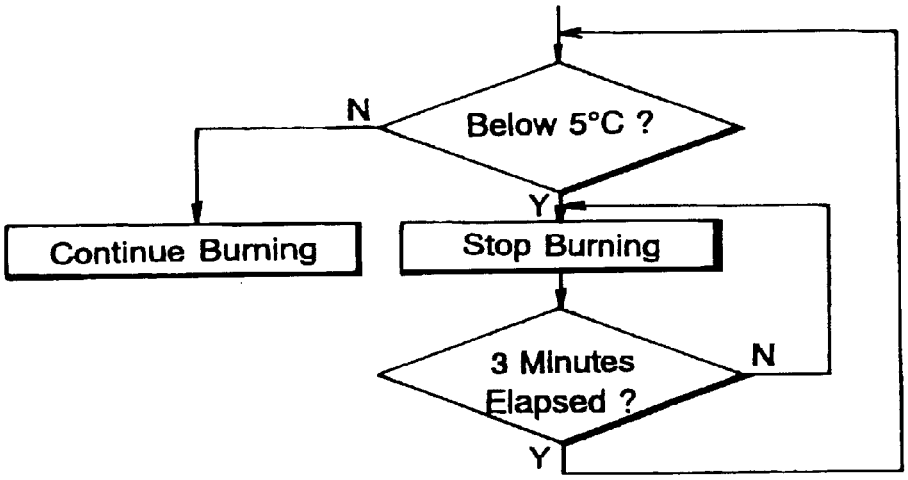
FIG. 8 is a flow chart for the operation of preventing hypercooling.
Figure 9:
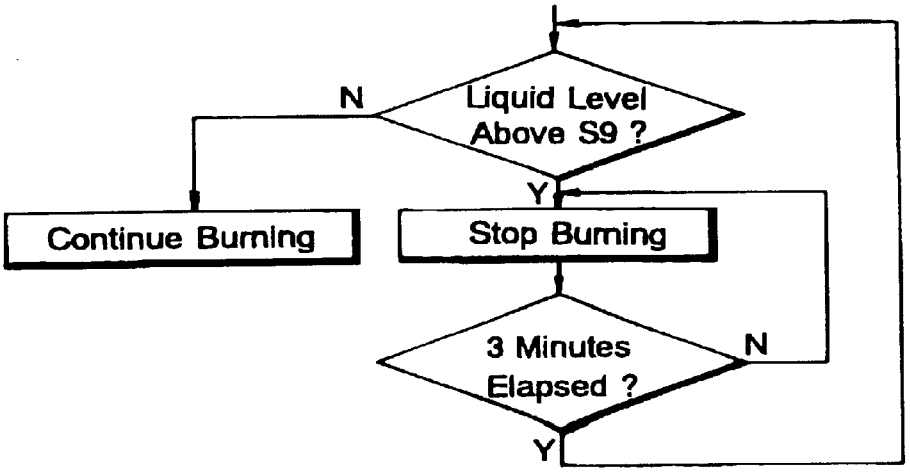

FIG. 6 is a circuit diagram of a third embodiment of air conditioning system according to the invention comprising a heat source side unit 1 having a heat exchanger 2 and typically housed in a machine housing located on the roof of a building and a number of user side units 4 having respective heat exchangers 5, said heat exchangers 2 and 5 are connected by way of liquid phase piping 6, gas phase piping 7 and flow control valves 8 to form a closed circuit 3.

Along the liquid phase piping 6, there are arranged in series a receiver tank 21 for storing the liquid R-134a that has been condensed and flown out of the heat exchanger 2 of the heat source side unit 1 after emitting heat in the heat exchanger 2, a small motor pump 22 for operating in the cooling cycle to transfer the liquid R-134a held in the receiver tank 21 to the user side units 4 and a cooling/heating switch valve 23. Additionally, a receiver tank 24 for storing the liquid R-134a that has been condensed and flown out of the heat exchangers 5 of the user side units 4 after emitting heat in the heat exchangers 5, a large motor pump 25 for operating in the heating cycle to transfer the liquid R-134a held in the receiver tank 24 to the heat source side unit 1 and a cooling/heating switch valve 26 are arranged in series but in parallel with the above serially arranged receiver tank 21, the small motor pump 22 and the switch valve 23. The receiver tanks 21 and 24 are provided respectively with pairs of sensors S5 and S6 and S7 and S8 for detecting the respective liquid levels of the tanks, said pairs S5 and S6 and S7 and S8 being differentiated in terms of elevation.

The inlet and outlet ports of the heat exchanger 2 of the heat source side unit 1 are made to communicate with each other and provided with a liquid level detecting tube 27, which pipe 27 is by turn provided with a pair of sensors 59 and S10 that are differentiated in terms of elevation.

Otherwise, there are provided a fuel regulation valve 28 arranged in a fuel pipe connected to a burner 29 in order to evaporate and isolate the refrigerant vapor by heating the absorbent liquid (not shown), a pressure sensor S11 for detecting the pressure of the R-134a flown out from the heat exchanger 2 into the liquid phase piping 6 and a pair of temperature sensors S12 and S13 arranged at the outlet and inlet ports of the heat exchanger respectively to detect the temperature of the R-134a circulating through the closed circuit 3.

The heat source side unit 1 is provided with a heat source side controller 17 for controlling the fuel regulation valve 28 in such a way that, in the cooling cycle, the opening of the fuel regulation valve 28 is held to such an extent that the pressure of the R-134a detected by the pressure sensor S11 that has been condensed by the cooling effect of the heat exchanger 2 and discharged into the liquid phase piping 6 may be held to the equilibrium pressure of about 7.5 Pa where R-134a is condensed at 7° C. and the fuel regulation valve 28 is closed when the temperature of the R-134a as detected by the temperature sensor S13 falls below a predetermined level, for example 5° C., as the R-134a is cooled by the heat exchanger 2 to become condensed and discharged into the liquid phase piping 6, whereas, in the heating cycle, the opening of the fuel regulation valve 28 is held to such an extent that the temperature of the R-134a as detected by the temperature sensor S12 is held to a predetermined level, for example 55° C., as the R-134a is heated by the heat exchanger to evaporate and discharged into the gas phase piping 7. On the other hand, each of the user side units 4 is provided with a user side controller 18 for controlling the related flow control valve 8 in such a way that, in the cooling cycle, the opening of the flow control valve 8 is held to such an extent that the temperature of the R-134a as detected by the temperature sensor S2 is held to a predetermined level, for example 12° C., as the R-134a is heated by the heat exchanger 5 to evaporate and discharged into the gas phase piping 7, whereas, in the heating cycle, the opening of the flow control valve 8 is held to such an extent that the temperature of the R-134a as detected by the temperature sensor S1 is held to a predetermined level, for example 50° C., as the R-134a is cooled by the heat exchanger 5 to become condensed and discharged into the liquid phase piping 6.

In the heat source side unit 1, the amount of the refrigerant evaporated and isolated from the absorbent liquid (not shown) will be increased if the opening of the fuel regulation valve 28 operating in the cooling mode is extended to allow more fuel to enter the burner 29 and burn more furiously. The refrigerant vapor with an increased volume then emits heat in a condenser (not shown) to become condensed into liquid before it is fed to an area surrounding the heat exchanger 2, where it is evaporated again by absorbing heat from the R-134a flowing through the heat exchanger 2. Thus, the effect of cooling the R-134a flowing through the heat exchanger 2 will be boosted to increase the temperature fall thereof if R-134a flows always at a same flow rate. Conversely, if the opening of the fuel regulation valve 28 is contracted to allow less fuel to enter the burner 29 and burn less furiously, then the effect of heating the R-134a flowing through the heat exchanger 2 is subdued to consequently reduce the temperature fall thereof.

On the other hand, the amount of the refrigerant evaporated and isolated from the absorbent liquid (not shown) will also be increased if the opening of the fuel regulation valve 28 operating in the heating mode is extended to allow more fuel to enter the burner 29 and burn more furiously. The refrigerant vapor with an increased volume and the absorbent liquid that has been heated and released the refrigerant are then fed to an area surrounding the heat exchanger 2 to heat the R-134a flowing through the heat exchanger. Thus, the effect of heating the R-134a flowing through the heat exchanger 2 will be boosted to increase the temperature rise if R-134a flows always at a same flow rate. Conversely, if the opening of the fuel regulation valve 28 is contracted to allow less fuel to enter the burner 29 and burn less furiously, then the effect of heating the R-134a flowing through the heat exchanger 2 is subdued to consequently reduce the temperature rise thereof.

At the user side units 4, the temperature difference detected by the temperature sensors S1 and S2 will be increased when the air conditioning load is large, provided that the openings of the flow control valves 8 are held constant. Conversely, the temperature difference will be reduced when the air conditioning load is small.

Now, the circulation of the R-134a sealed in the closed circuit 3 will be described. In the cooling mode, the cooling/heating switch valve 26 is closed while the motor pump 25 is at rest, whereas the cooling/heating switch valve 23 is opened while the motor pump 22 is driven to operate according to a control signal transmitted from the heat source side controller 17. Then, the R-134a in the closed circuit 3 is cooled to become condensed by the pipe walls of the heat exchanger 2 of the heat source side unit 1 and then discharged into the liquid phase piping 6 under 7.5 Pa and at 7° C. The discharged R-134a is stored in the receiver tank 21 and then fed to the user side units 4 by its own weight and the discharge effect of the motor pump 22.

Then, in each of the user side units 4, the liquid R-134a fed from the heat source side unit 1 at low temperature of 7° C. absorbs heat from the hot air blown to the heat exchanger 5 by the blower 16 to consequently cool the inside of the room.

The evaporated R-134a is then condensed and liquefied before it flows into the gas phase piping 7 and then further into the heat exchanger 2 of the heat source side unit 1, which is held u under low pressure.

If the cooling load of one of the user side units 4 is increased (or decreased) to raise (or lower) the temperature of R-134a detected by the temperature sensor S2 of the unit 4 while the R-134a is circulating, the related flow control valve 8 extends (or contracts) its opening according to the control signal transmitted from the heat source side controller 18 of the unit 4 in order to cancel the temperature rise (or temperature fall) so that more (or less) R-134a is allowed to flow into the heat exchanger 5 of the unit 4 and consequently the temperature rise (or temperature fall) in the R-134a detected by the temperature sensor 2 will be canceled.

Any change in the pressure and temperature of the R-134a in each of the user side units 4 caused by a change in the cooling load will quickly affect the pressure of R-134a detected by the pressure sensor S11 of the heat source side unit 1. While the temperature sensor S13 detects the change in the temperature of R-134a only when the R-134a heated (or cooled) in the user side unit 4 starts flowing into the heat source side unit 1 (the thermal conduction of R-134a is negligible if compared with the circulation speed of R-134a), any change in the pressure of R-134a in the user side unit 4 is transmitted quickly to the heat source side 1.

Then, the fuel regulation valve 28 is controlled for its opening according to the pressure of R-134a detected by the highly responsive pressure sensor S11. More specifically, as any change in the pressure of R-134a is detected by the pressure sensor S11, the heat source side controller 17 controls the opening of the fuel regulation valve 28 so as to cancel the change. Therefore, no troublesome phenomena such as an abrupt fall in the pressure of the closed circuit 6 that makes the liquid R-134a in the liquid phase piping 6 boil and generate bubbles to block the R-134a circulation will be effectively avoided.

The fuel regulation valve 28 is controlled also by the output of the temperature sensor S13. The heat source side controller 17 is also connected to the temperature sensor S13 so that, when the temperature of R-134a detected by the temperature sensor S13, which is the temperature of the R-134a cooled and condensed by the heat exchanger 2, is higher than 5° C., the controller 17 makes the burner 29 keep on burning fuel, whereas it closes the fuel regulation valve 28 to stop the burning operation of the burner 28 when the detected temperature of R-134a is short of 5° C. See the flow chart of FIG. 8.

As the fuel regulation valve 28 is closed to stop the burning operation of the burner S9, the volume of the liquid refrigerant fed to an area surrounding the heat exchanger 2 is rapidly decreased to quickly reduce the cooling effect. Then, after a predetermined period of time, say 3 minutes, the temperature sensor S13 detects the temperature of R-134a for another time.

Due to the above described control operation, the phenomenon of hypercooling and freezing, if partly, the refrigerant (solution) of the absorption type freezer that constitutes a component of the heat source side unit 1 can be effectively avoided while the fuel regulation valve 28 is efficiently controlled for its opening to in turn control the temperature of R-134a by detecting changes in the pressure of R-134a that is more responsive than the temperature.

The fuel regulation valve 28 is also controlled according to the level of the R-134a condensed and liquefied by the heat exchanger 2. The heat source side controller 17 is connected also to the liquid level sensor S9 arranged at a lower position of the liquid level detecting tube 27 so that, when the liquid level sensor S9 does not detect any R-134a, the burner 29 is made to keep on burning fuel, whereas the fuel regulation valve 28 is closed to stop the burning operation and hence the cooling operation when the liquid level sensor S9 detects R-134a. See the flow chart of FIG. 9.

As the fuel regulation valve 28 is closed to stop the operation of the burner 29 for heating the refrigerant, the volume fed to an area surrounding the heat exchanger 2 is decreased abruptly to rapidly raise the temperature of the R-134a there as described above. Then, the pressure in the heat exchanger 2 rises to discharge more R-134a into the liquid phase piping 6. Then, after a predetermined period of time, say 3 minutes, the temperature sensor S9 detects the temperature of R-134a for another time.

With the above described control operation, the phenomenon that the heat source side unit 1 holds a large volume of liquid R-134a and only an insufficient amount of R-134a circulates through the user side units will be effectively avoided.

In the heating mode, R-134a will be circulated by opening the cooling/heating switch valve 26 and driving the motor pump 25 while the cooling/heating switch valve 23 is closed and the motor pump 22 is held at rest. This mode of operation will be described below.

Under this condition, a heating operation is conducted in the heat source side unit 1 to heat the R-134a there by way of the pipe walls of the heat exchanger 2. Then, evaporated R-134a is discharged into the gas phase piping 7 and fed to the heat exchangers 5 of the user side units 4 at a predetermined temperature level, which may typically be 55° C.

At each of the user side units 4, where cold air is forcibly blown onto the heat exchanger 5 by means of the blower 16, the gaseous R-134a fed from the heat at source side unit 1 at 55° C. quickly emit heat into the room for the heating cycle and becomes condensed.

The condensed and liquefied R-134a is then held in the receiver tank 24 before it is fed back to the heat exchanger 2 of the heat source side unit 1 via the liquid phase piping 6 by means of the motor pump 25.

Figure 10:
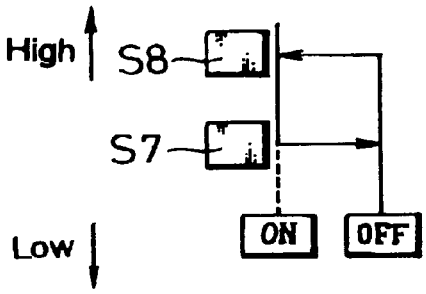
FIG. 10 is a schematic circuit diagram of a controller for controlling the heating motor pump for the purpose of the present invention.
Figure 11:
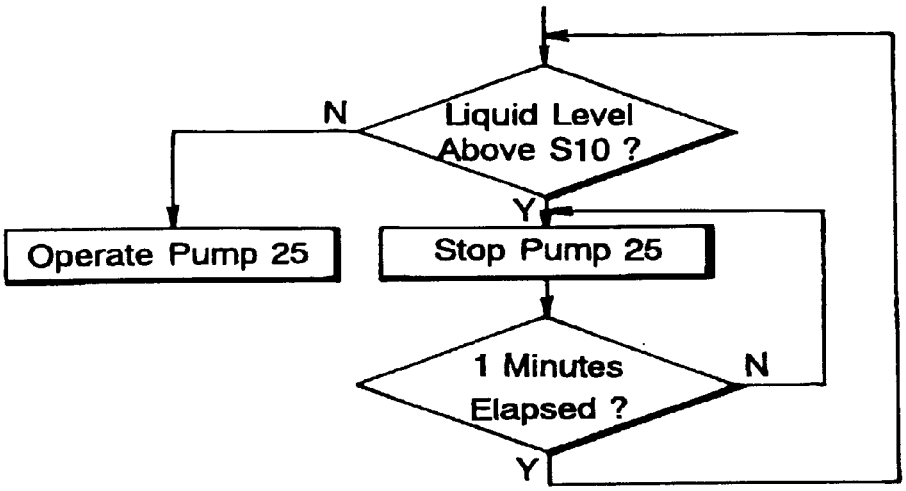
FIG. 11 is a flow chart for the operation of preventing refrigerant R-134a in the liquid phase from flowing into the gas phase part of the piping.

The operation of the motor pump 25 is controlled by the heat source side controller 17 as illustrated in FIG. 10. As long as the upper liquid level sensor S8 of the receiver tank 24 detects R-134a, the motor pump 25 is driven. On the other hand, once the lower liquid level sensor S7 stops sensing R-134a, the operation of the motor pump 25 will be stopped. If the lower liquid level sensor S7 detects R-134a and the higher liquid level sensor S8 does not detects R-134a, then the motor pump will be driven on if it is being driven and it will be held at rest if it is currently at rest.

The operation of the motor pump 25 is also controlled by the level of the liquid R-134a that is generating vapor as it is heated by the heat exchanger 2. The heat source side controller 17 is connected to the liquid level sensor S10 arranged at a higher position of the liquid level detecting tube S7 and controls the motor pump 25 to make it keep on operating so long as the liquid level sensor S10 does not detect R-134a but stop its operation once the liquid level sensor S10 detects R-134a in a manner as shown in the flow chart of FIG. 11.

By controlling the motor pump 25 as described above, the phenomenon that liquid R-134a flows into the gas phase piping 7 will be effectively avoided. Then, after a predetermined period of times say 1 minutes, the liquid level sensor S10 tries to detect R-134a for another time.

If the heating load of one of the user side units 4 is increased (or decreased) to lower (or raise) the temperature of R-134a detected by the temperature sensor S4 of the unit 4 while the R-134a is circulating, the related flow control valve 8 extends (or contracts) its opening according to the control signal transmitted from the heat source side controller 18 of the unit 4 in order to cancel the temperature fall (or temperature rise) so that more (or less) R-134a is allowed to flow into the heat exchanger 5 of the unit 4 and consequently the temperature fall (or temperature rise) in the R-134a as detected by the temperature sensor 2 will be canceled.

If the R-134a changes its temperature and flows into the heat source side unit 1 or the flow rate of R-134a is changed to change the temperature of R-134a as detected by the temperature sensor S12 due to a change in the heating load, the fuel regulation valve 28 is so controlled for its opening by the heat source side controller 17 as to cancel the change in the R-134a temperature.

Figure 12:
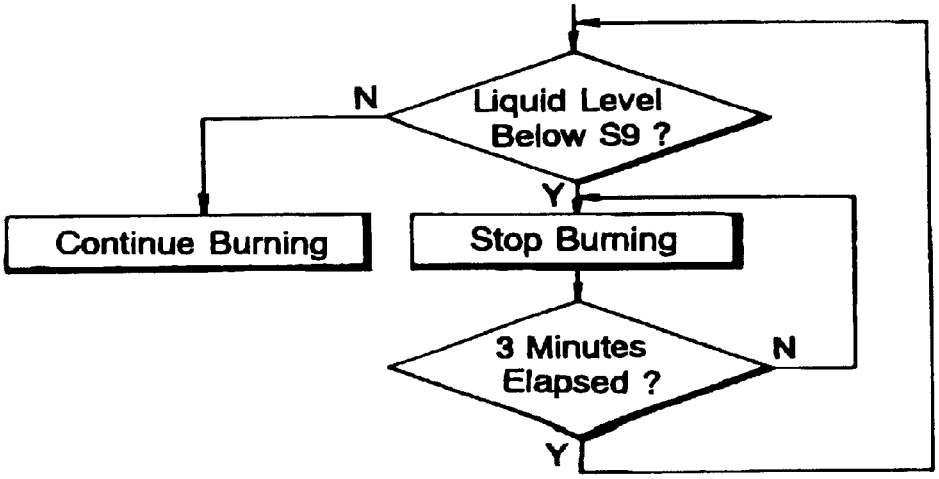
FIG. 12 is a flow chart for the operation of preventing the user side units from being heated when it is empty.
Figure 13:
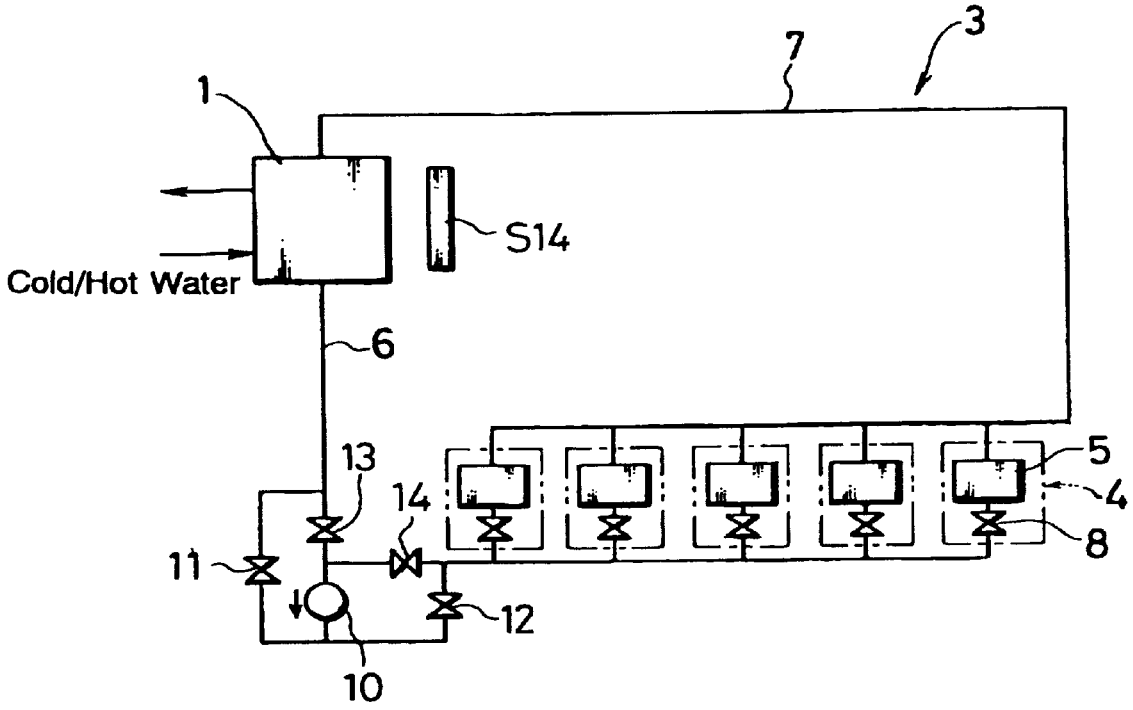
Fig. 13 Prior Art
FIG. 13 is a schematic circuit diagram of a prior art.

The fuel regulation valve 28 is also controlled by the output of the liquid level sensor S9. As shown in FIG. 12, under the control of the heat source side controller 17, the fuel regulation valve 28 causes the burner 29 to keep on its burning operation so long as the liquid level sensor S9 detects R-134a but closes itself to stop the burning operation of the burner 29 once the liquid level sensor S9 stops sensing R-134a.

With the above described control operation, the burner 29 is prevented from burning fuel while there is not enough amount of R-134a. Then, after a predetermined period of time, say 3 minutes, the liquid level sensor S9 tries to detect R-134a for another time.

It should be noted that the present invention is by no means limited to the above embodiments, which may be modified in various different ways without departing from the spirit and scope of the invention.

The phase-changeable fluid to be sealed in the closed circuit 3 may be selected from R-407c, R-404A, R-401c and other commercially available fluids in addition to R-134a.

As described above, an air conditioning system according to the first aspect of the invention can provide a sufficient cooling effect regardless of the floors where the user side units are installed. The power consumption rate of the system in summer, when the local demand for electric power may be maximal, can be minimized if the number of revolutions per unit time of the liquid pump is controllably arranged.

An air conditioning according to the second aspect of the invention is also able to provide a sufficient cooling/heating effect although a small first liquid pump is used for starting the cooling cycle. Additionally, it can also minimize the power consumption rate in summer, when the local demand for electric power man be maximal.

If the capacity of the heat source side unit is controlled according to the pressure of the condensed fluid being supplied from the heat source side unit in an air conditioning according to the second aspect of the invention, then the problem that liquid refrigerant boils up to generate bubbles in the liquid phase piping to block the circulation of refrigerant can be effectively prevented. The heat source side unit may be constituted by an absorbing type freezer to minimize the power consumption rate in the cooling mode of operation without freezing the refrigerant (solution) in any situation.

If an air conditioning system according to the second aspect of the invention further comprises a receiver tank arranged on the suction side of the first liquid pump for storing condensed fluid supplied from the heat source side unit and a detection means for detecting the volume of the fluid in the heat source side unit, the control means being so adapted to stop the operation of the first liquid pump when the level of the liquid in the receiver tank falls below a predetermined level and that of the heat source side unit when the volume of the liquid in the heat source side unit as detected by the detection means exceeds a predetermined level, then the problem that liquid refrigerant is excessively stored in the heat source side unit whereas only an insufficient amount of refrigerant circulates through the user side units can be effectively avoided.

If, alternatively, an air conditioning system according to the second aspect of the invention further comprises a receiver tank arranged on the suction side of the second liquid pump for storing fluid in the liquid phase and a detection means for detecting the volume of the fluid in the heat source side unit, the control means being so adapted to stop the operation of the second liquid pump when the level of the liquid in the receiver tank falls below a predetermined level or the volume of the liquid in the heat source side unit detected by the detection means exceeds a first predetermined level and that of the heat source side unit when the volume of the liquid in the heat source side unit as detected by the detection means falls below a second predetermined level lower than the first predetermined level, then the problem that liquid refrigerant flows into the gas phase piping from the heat source side unit that is operating as an evaporator can be effectively prevented. Additionally, the air conditioning is free from the problem that the burner continues burning operation without any refrigerant.

Finally, if an air conditioning system according to the invention comprises a receiver tank arranged on the suction side of the second liquid pump and the discharge side of the first liquid pump and an upper portion of the receiver tank are connected to each other by way of a relief valve adapted to be opened under pressure exceeding a predetermined levels then the user side units can be supplied with liquid refrigerant at a sufficient rate.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An air conditioning system characterized by comprising a heat source side unit adapted to condense and supply a fluid which can change a phase between a gas phase and a liquid phase, a plurality of user side units more than half of which are disposed below the heat source side unit in terms of number and which are connected to said heat source side unit by piping so as to establish a circulation of the fluid supplied from said heat source side unit passing through said heat source side unit and said user side units by utilizing the difference in specific gravity between the liquid phase and the gas phase of said liquid, a liquid pump arranged along the liquid phase part of the piping for forcibly boosting the circulation of the fluid in the liquid phase by its pumping power to operate said user side units for cooling ambient air and a control means for controlling the operation of said liquid pump so as to make a preselected physical amount achieve a predetermined state, wherein said control means controls the number of revolutions per unit time of said liquid pump by detecting a physical volume relating to the air conditioning load of said user side units.

2. An air conditioning system according to claim 1, wherein said control means controls the number of revolutions per unit time of said liquid pump by modifying the number of poles of the electric motor for driving said liquid pump, the frequency of the AC being fed to said drive motor and/or the voltage or the intensity of the AC if said control means is adapted to detect a physical volume relating to the air conditioning load of the user side units.

3. An air conditioning system characterized by comprising a heat source side unit adapted to condense/evaporate and supply a fluid which can change a phase between a gas phase and a liquid phase, a plurality of user side units entirely or mostly disposed below the heat source side unit in terms of number and connected to said heat source side unit by piping so as to establish a circulation of the fluid supplied from said heat source side unit passing through said heat source side unit and said user side units by utilizing the difference in specific gravity between the liquid phase and the gas phase of said liquid, a first liquid pump arranged along the liquid phase part of the piping for forcibly boosting the circulation of the fluid in the liquid phase by its pumping power to supply said user side units with fluid including the liquid phase and causing the supplied fluid to evaporate in the user side units for cooling ambient air, a second liquid pump arranged along a part of the piping adapted to send the fluid in said liquid phase part of the piping back to said heat source side unit, a switch valve arranged between the discharge side of said first liquid pump and said liquid phase part of the piping and adapted to be opened for cooling and closed for heating so as to cause the fluid in the gas phase to be evaporated in and supplied from said heat source side unit to circulate through said user side units and said heat source side unit under the negative pressure generated by the second liquid pump and cause the gas phase supplied to the user side units to be condensed therein for a subsequent heating operation and control means for controlling the operation of said heat source side unit according to the condition of the fluid circulating through said heat source side unit and said user side units, said air conditioning system further comprising:

a receiver tank arranged on a suction side of said first liquid pump for storing condensed fluid supplied from said heat source side unit and a detection means for detecting the volume of the fluid in said heat source side unit, said control means adapted to stop the operation of said first liquid pump when the level of the liquid in said receiver tank falls below a predetermined level and further adapted to stop the operation of said heat source side unit when the volume of the liquid in said heat source side unit as detected by said detection means exceeds a predetermined level; wherein a discharge side of said first liquid pump and an upper portion of said receiver tank are connected to each other by way of a relief valve adapted to be opened under pressure exceeding a predetermined level.

4. An air conditioning system according to claim 3, wherein said control means of an air conditioning system according to the second aspect of the invention controls the capacity of said heat source side unit according to the pressure of the condensed fluid being supplied from said heat source side unit and stops the operation of said heat source side unit when the temperature of the fluid exceeds below a predetermined level.

* * * * *

UNITED STATES PATENT AND TRADEMARK OFFICE
CERTIFICATE OF CORRECTION

PATENT NO : 5,966,954
DATED : October 19, 1999
INVENTOR(S) : Hidetoshi Arima, et al.

It is certified that error appears in the above-identified patent and that said Letters Patent are hereby corrected as shown below:

Front Page, [30], "Jun. 11, 1997", should read --Jun. 11, 1996--; and

Column 2, line 6, lo, should read --10--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*